United States Patent [19]

Glavan

[11] 4,194,642

[45] Mar. 25, 1980

[54] FURNITURE COMPONENT SYSTEMS

[76] Inventor: Ljiljana Glavan, 2029 Beaconwood Dr., Ottawa, Ontario, Canada

[21] Appl. No.: 879,715

[22] Filed: Feb. 21, 1978

[30] Foreign Application Priority Data

Mar. 3, 1977 [CA] Canada ..... 273084

[51] Int. Cl.[2] ..... B65D 9/12; B65D 9/34; B65D 7/00

[52] U.S. Cl. ..... 217/12 R; 403/405; 220/4 F; 217/43 R; 217/65

[58] Field of Search ..... 217/12 R, 12 A, 13, 217/45, 65, 69, 43 R, 43 A; 220/4 F; 312/263, 111; 403/169, 177, 178, 206, 213, 252, 306, 405, 408

[56] References Cited

U.S. PATENT DOCUMENTS

| | | | |
|---|---|---|---|
| 446,914 | 2/1891 | Fletcher | 403/405 X |
| 787,645 | 4/1905 | Russell | 217/43 |
| 1,089,360 | 3/1914 | Goodrow | 403/405 X |
| 2,877,519 | 3/1959 | Propst | 217/65 |
| 4,002,261 | 1/1977 | Litchfield | 220/4 F X |
| 4,125,338 | 11/1978 | Lew | 312/263 X |

FOREIGN PATENT DOCUMENTS

| | | |
|---|---|---|
| 318850 | 11/1974 | Austria . |
| 862049 | 1/1953 | Fed. Rep. of Germany . |
| 2229306 | 1/1974 | Fed. Rep. of Germany . |
| 2514357 | 10/1975 | Fed. Rep. of Germany . |
| 2617614 | 11/1976 | Fed. Rep. of Germany . |
| 239726 | 2/1946 | Switzerland . |

*Primary Examiner*—Steven M. Pollard

*Attorney, Agent, or Firm*—Cushman, Darby & Cushman

[57] ABSTRACT

A furniture component system comprises connecting members each having a pair of mutually angularly divergent limbs, and plate-shaped members having at least one edge formed with at least two holes extending inwardly of the respective plate-shaped member, each of the holes being dimensioned to receive therein one of the connecting member limbs, whereby the plate-shaped members are connectible together in mutually angularly disposed relationship, whereby relative movement apart of a connected pair of the plate-shaped members may be restricted to one direction only. Preferably, the plate-shaped members are rectangular and the connecting members are L-shaped. The system can be assembled to form boxes, cupboards, shelves, tables and other articles of furniture.

31 Claims, 18 Drawing Figures

FURNITURE COMPONENT SYSTEMS

The present invention relates to furniture component systems which can be assembled to form articles of furniture, for example, boxes, cupboards, shelving and tables.

In recent years, the manufacture and marketing of furniture component systems have become increasingly popular. Such systems have various advantages. For example, they make it possible for the user to assemble articles of furniture which are adapted to his own particular requirements, and which can be subsequently changed and added to by the purchase of further components. Furthermore, with so-called knock-down furniture, by the use of a plurality of components which can be secured together in a simple manner by the eventual user, manufacturers, wholesalers, retailers, and indeed the eventual user, have the advantage that the components can be very compactly packaged for storage and transportation, and this compact packaging is particularly important when the manufacturer is at a considerable distance from the eventual user.

It is an object of the present invention to provide a novel and improved furniture component system which has a low manufacturing cost, which is very easy to assemble, even without the use of tools, and which is sufficiently versatile to be adapted to the assembly of various different kinds of furniture.

According to the present invention, a furniture component system comprises furniture components which can be releasably connected by angle-shaped connecting members slidingly engaging in holes in the components, and the holes in selected ones of the components are mutually parallel, while those in the remaining components are mutually angled. Each connecting member has one limb engaged in one of the parallel holes and another limb engaged in one of the mutually angled holes. In this way, the components are so connected that they can only be moved apart from one another in the directions of the parallel holes.

The components may be rectangular plate-shaped members and the connecting members are L-shaped, the plate-shaped members being connected together at right angles to one another. However, it is also possible to make the plate-shaped members hexagonal, or of other polygonal shapes, in which case the mutual angular relationship of limbs of the connecting members is correspondingly different.

To enable the plate-shaped members to be connected together by the connecting members in such a manner that one of them can be pivotable to and from a normal, closed position, in which it is surrounded, adjacent its edges, by other of the plate-shaped members, the lengths of the limbs of the connecting members are preferably made sufficiently longer than the lengths of the holes to provide a spacing between the plane of each of the plate-shaped members and the adjacent plate-shaped members connected thereto on assembly of the system.

The invention will be more readily understood from the following description, given by way of example only, of preferred embodiments thereof illustrated in the accompanying drawings, in which.

Figure 1:
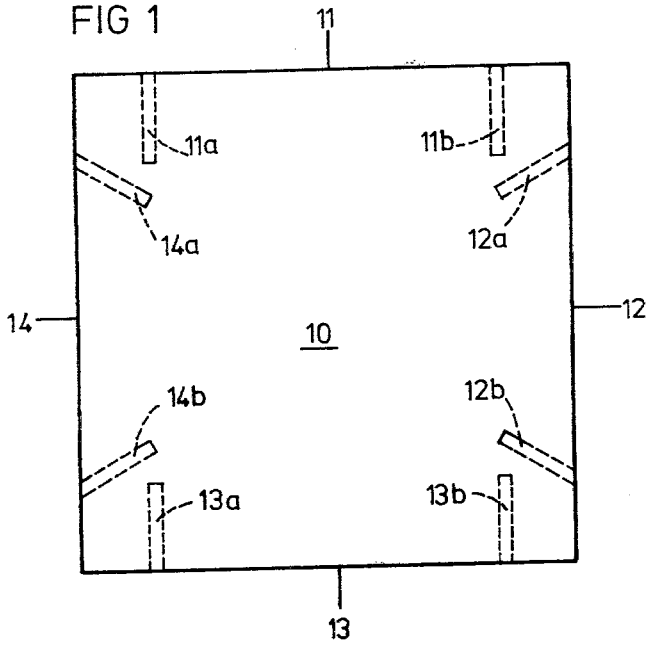
FIG. 1 shows a plan view of a plate-shaped member forming part of a first furniture component system.
Figure 2:
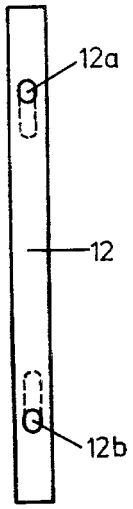
FIG. 2 shows a view in elevation of one side of the plate-shaped member of FIG. 1.
Figure 3:
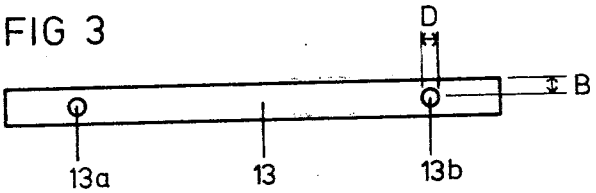
FIG. 3 shows a view in elevation of an adjacent side of the plate-shaped member of FIG. 1.

The plate-shaped member illustrated in FIGS. 1 to 3, which is indicated by reference numeral 10, is made of plywood or of different types of wood or other materials, such as particle board or fibre reinforced plastics material.

As can be readily seen from FIGS. 1 to 3, the plate-shaped member 10 is square, and has four side edges 11, 12, 13 and 14 and opposite major surfaces. Each of these four edges, in this embodiment of the invention, is formed with two holes, the holes being of circular cross-section and extending inwardly from their respective edges of the plate-shaped member and between and parallel to the major surfaces thereof.

More particularly, the edges 11 and 13 are each formed with a pair of mutually parallel holes 11*a*, 11*b* and 13*a*, 13*b* respectively, which extend perpendicularly from their respective edges 11 and 13.

The edges 12 and 14 are likewise each formed with a pair of holes 12*a*, 12*b* and 14*a*, 14*b* respectively, but in this case the holes 12*a*, 12*b* and 14*a*, 14*b* do not extend perpendicularly from the edges 12 and 14, but at an acute angle thereto, these holes being mutually angled towards the central region of the plate-shaped member 10.

Figure 4:
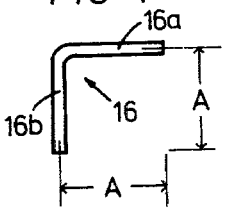
FIG. 4 shows a side view of a connecting member.

As will be described in greater detail hereinafter, the plate-shaped member 10 is intended to be connected together with a plurality of other plate-shaped members to form an article of furniture. For this purpose, a plurality of connecting members are provided, one of which is illustrated in FIG. 4 and is indicated generally by reference numeral 16.

The connecting member 16, which is made by cutting and bending a cylindrical rod made of steel or any other suitable metal or other material, is L-shaped, and has two limbs 16*a* and 16*b* which are of equal lengths, each having a length A, and which extend at right angles to one another.

Figure 5:
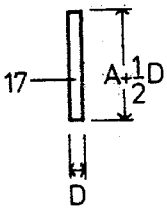
FIGS. 5 and 6 show side views of a pair of door stop abutment members.
Figure 6:
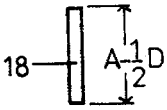

The two door stop abutment members shown in FIGS. 5 and 6, and indicated by reference numerals 17 and 18, the purpose and function of which will become readily apparent as this description proceeds, are likewise cut from cylindrical steel rod, and have the same diameter D as the limbs 16*a* and 16*b* of the connecting member 16. However, the door stop abutment members 17 and 18 are of different lengths, the length of the door stop abutment member 17 being $A+\frac{1}{2}D$, and that of the door stop abutment member 18 being $A-\frac{1}{2}D$, as indicated in the drawing.

Figure 7:
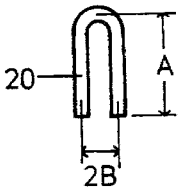
FIG. 7 shows a side view of a modified connecting member.

FIG. 7 shows a U-shaped connecting member 20 which is also formed by cutting and bending cylindrical steel rod of diameter D and which, as can be seen from FIG. 7, has two arms of equal lengths, the longitudinal centre lines of which are spaced apart by a distance 2B.

Figure 8:
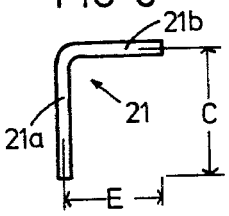
FIG. 8 shows a side view of a door latch.

FIG. 8 shows a door latch member indicated by reference numeral 21 which is similar to the connecting member of FIG. 4 but which has two limbs 21*a* and 21*b* of unequal lengths, the arm 21*a* having a length C and the arb 21*b* having a length E.

A furniture component system employing the components which have thus far been described with reference to FIGS. 1 to 8 comprises a plurality of each of these components, as will become readily evident from the following description of the assembly of a typical article of furniture from these components.

Reference is now made to FIGS. 9 to 12, which illustrate the assembly of a box-shaped cupboard from these components.

To facilitate and simplify the following description of the box-shaped cupboard, the plate-shaped members employed to form this cupboard are indicated by reference numerals 10*a* to 10*f*, and it is to be understood that, in the present embodiment of the invention, each of these plate-shaped members is identical to the plate-shaped member 10 illustrated in FIGS. 1 to 3.

Figure 9:
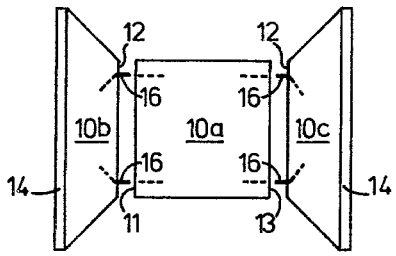
FIGS. 9 to 12 show successive stages in the assembly of a box-shaped cupboard.
Figure 10:
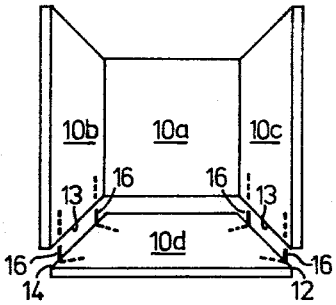
Figure 11:
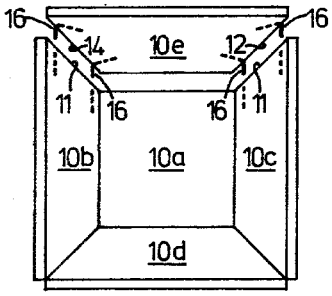

As shown in FIG. 9, the plate-shaped member 10*a* is firstly disposed with its edges 11 and 13 extending vertically at opposite sides thereof, and the plate-shaped members 10*c* and 10*b* are disposed with their edges 12 and 14 vertical, the edges 12 of the plate-shaped members 10*c* and 10*b* being adjacent the vertical 11 and 13 of the plate-shaped member 10*a*. Connecting members 16 are inserted into the inclined holes 12*a* and 12*b* of the plate members 10*b* and 10*c* so as to project therefrom towards the edges 11 and 13 of the plate member 10*a*, and the projecting portions of the connecting members 16 and then inserted into the holes 11*a*, 11*b* and 13*a*, 13*b* of the plate member 10*a*. In this way, the plate members 10*b* and 10*c* are secured to the plate member 10*a* at right angles thereto and in mutually parallel relationship. However, as will be readily apparent, the plate members 10*b* and 10*c* are not at this time locked together with the plate member 10*a*.

In the next step in this assembly, the plate member 10*d* is connected by further connecting members 16 to the undersides of the plate members 10*b* and 10*c*, with the edges 12 and 14 of the plate member 10*d* adjacent the respective edges 13 of the plate-shaped members 10*b* and 10*c*.

The plate-shaped member 10*e*, which forms the top of the cupboard, is then connected in a similar manner to the upper edges of the plate-shaped members 10*b* and 10*c*, with the edges 12 and 14 of the former adjacent the edges 11 of the latter.

With the assembly as thus-far described, the plate-shaped members 10*d* and 10*e*, forming the bottom and the top, respectively, of the cupboard prevent the plate-shaped members 10*b* and 10*c*, which form the sidewalls of the cupboard, from being displaced horizontally relative to the plate-shaped member 10*a*, which forms the back of the cupboard. In this way, the sidewalls and the back of the cupboard are locked together by the top and the bottom of the cupboard.

The assembly thus far described forms a box and may, if so desired, by employed in this condition as an article of furniture. For example, the box may be used, either by itself or in side-by-side relationship and/or stacked relationship with other similar boxes, as described in greater detail below, and moreover the back or plate-shaped member 10*a* may be omitted from the or each box, for example when the system is utilized to make open shelving to serve as a room divider or to stand against a wall.

Figure 12:
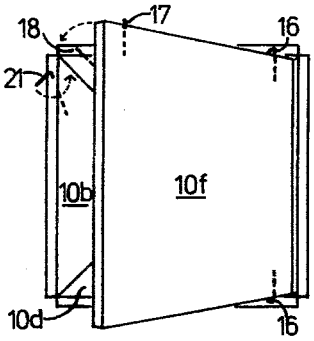

If it is desired to provide the box with a door, then the door may be added as illustrated in FIG. 12, in which the door is formed by the plate-shaped member 10*f*, which is disposed with its opposite edges 12 and 14 vertical.

The plate-shaped member 10*f* is secured to the horizontal plate-shaped members 10*d* and 10*e* by two connecting members 16 which, as will be evident from FIG. 12, are inserted into the holes 11*b* and 13*b* of the plate-shaped member 10*f*.

The door stop abutment member 17 is inserted into the hole 11*a* of the plate member 10*f*, and the door stop abutment member 19 is inserted into the hole 11*a* of the plate-shaped member 10*e*.

The latch member 21 is inserted into the hole 14*a* of the plate-shaped member 10*b*.

Figure 13:
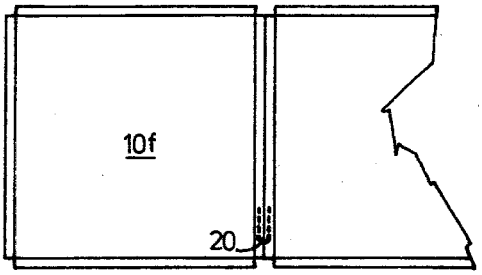
FIG. 13 shows a front view of a pair of box-shaped cupboards connected to one another.

FIG. 13 illustrates the manner in which the box-shaped cupboards, such as that shown in FIG. 12, are connected together by the U-shaped connecting member 20. The right-hand wall, formed by the plate-shaped member 10*c*, of the left-hand cupboard in FIG. 13 is firstly positioned in mutually parallel, adjacent and side-by-side relationship with the left-hand wall of the right-hand cupboard shown in FIG. 13, and the U-shaped connecting member 20 is then inserted into the adjacent holes 14*b* of these two walls.

As will be readily apparent, the above-described box or boxes can also be connected together by other U-shaped connecting members 20, inserted in a similar manner into holes in the back edges of the plate-shaped members 10*e* and 10*d*, to one or more other, similar boxes in vertically stacked relationship.

Figure 14:
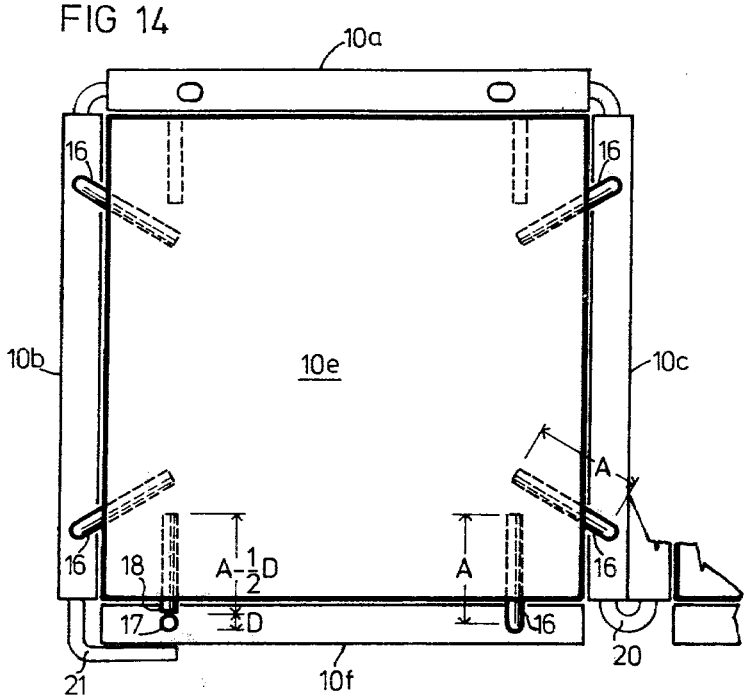
FIGS. 14 and 15 show a plan view and a front view, respectively, of the pair of box-shaped cupboards of FIG. 13, with one of the cupboards shown.

FIG. 14 shows in greater detail the manner in which the plate-shaped members are disposed relative to one another when connected together as described hereinabove.

As can clearly be seen from FIG. 14, gaps are provided between the adjacent edges of the plate-shaped members.

More particularly, the holes 11*a*, 11*b*; 12*a*, 12*b*; 13*a*, 13*b* and 14*a*, 14*b* formed in the plate-shaped members each have a length which is sufficiently shorter than the length A of one of the limbs of the connecting members 16 to ensure that there is a spacing between the plane of each of the plate-shaped members and the adjacent plate-shaped members connected thereto. For example, as viewed in FIG. 14, the connecting members 16, which are inserted as far as they will go into the plate-shaped member 10*e*, project laterally therefrom by a distance sufficient to ensure that the plate 10*e* is held offset from the vertical planes of the plate-shaped members 10*a*, 10*b*, 10*c* and 10*f*.

Figure 15:
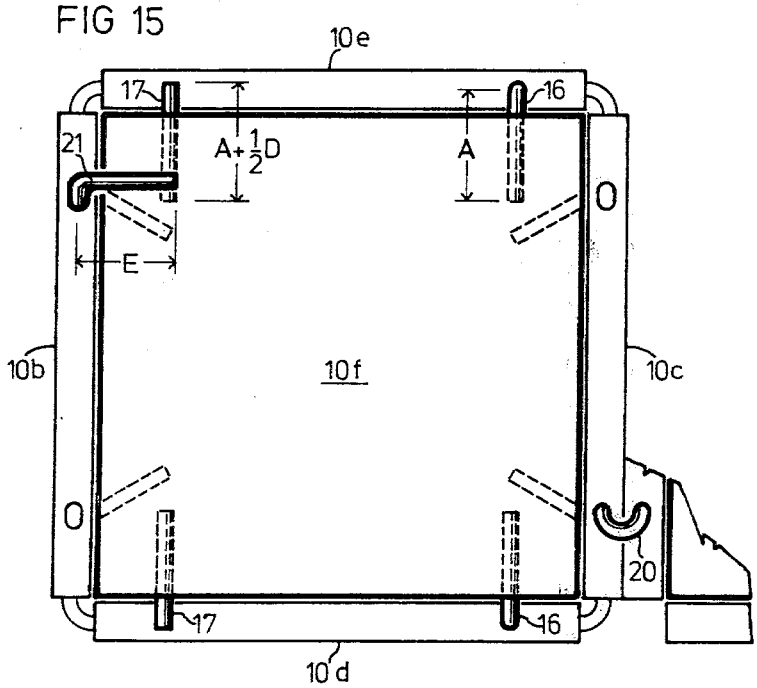

Similarly, as can be seen from FIG. 15, the connecting members 16 inserted into the plate-shaped member 10*f* project sufficiently far therefrom to ensure that the plate-shaped member 10*f* is spaced from the planes of the adjacent plate-shaped members 10*b*, 10*c*, 10*d* and 10*e*, and can thus pivot from its closed position, in which it is shown in FIGS. 14 and 15, into an open position without abutment against the edges of the adjacent plate-shaped members.

FIGS. 14 and 15 also illustrate the use of the latch member 21 for retaining the plate-shaped member 10*f* in its closed position, and it will be understood that the latch member 21 can be pivoted relative to the sidewall in which it is inserted, i.e. the plate-shaped member 10*b*, to a position (not shown) which is out of the path of pivotation of the plate-shaped member 10*f* when it is desired to open the cupboard.

FIGS. 14 and 15 also show the door stop abutment members 17 and 18, and more particularly show a pair of these members in use at the top of the plate-shaped member 10*f* and a second pair in use at the bottom of the plate-shaped member 10*f*. These abutment members 17 and 18 may be secured in their respective plate-shaped members by a push-fit, or adhesive, and may, if required, be made magnetic, so as to serve as a magnetic door catch in addition to serving as a door stop, in which case the latch member 21 may be omitted.

Figure 16:
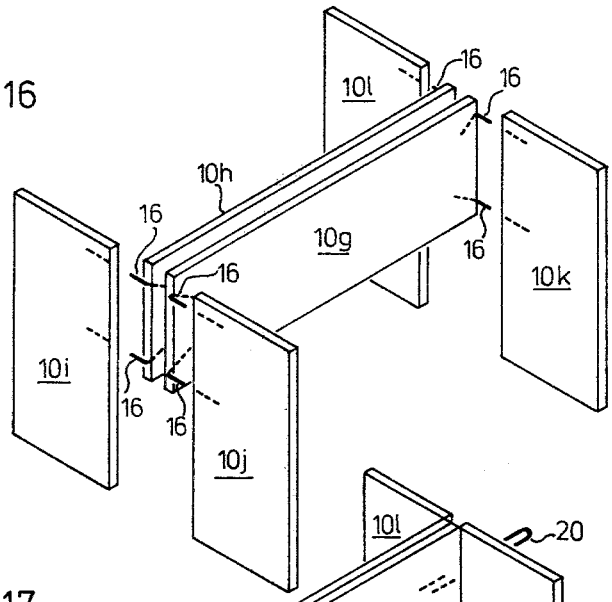
FIGS. 16 to 18 show three successive stages in the assembly of the table.
Figure 17:
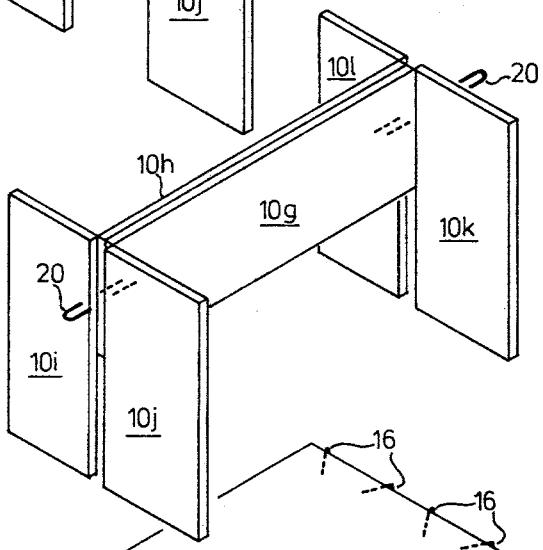
Figure 18:
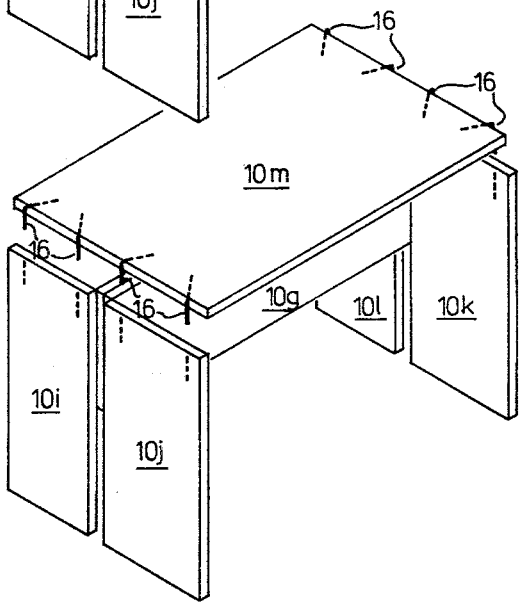

FIGS. 16 to 18 show three successive steps in the assembly of a table made from rectangular plate-shaped members 10*g* to 10*m*.

As can be seen from FIG. 16, the plate-shaped members 10*g* and 10*h* are formed, at their opposite end edges, with holes extending at an angle to the respective edges for receiving connecting members 16, the plate-shaped members 10*i* to 10*l* are formed with holes, indicated by broken lines, extending perpendicular to their edges for receiving the portions of the connecting members 16 projecting from the plate-shaped members 10*g* and 10*h*.

With the six plate-shaped members 10*g* to 10*l* thus loosely connected together and positioned as shown in FIG. 17, a pair of the U-shaped connecting members 20 are inserted into holes in the opposite end edges of the plate-shaped members 10*g* and 10*h* to connect the latter together.

To lock this assembly together, the plate-shaped member 10*m*, with connecting members 16 inserted into holes extending at an angle to opposite end edges of the plate-shaped member 10*m*, is then positioned as shown in FIG. 18, and lowered to insert the projecting limbs of these connecting members 16 into corresponding vertical holes in the top edges of the plate-shaped members 10*i* to 10*l*. When this has been done, the plate-shaped member 10*m* and its connecting members lock the remaining plate-shaped members 10*h* to 10*l* together against horizontal relative displacement.

FIGS. 19 to 25 illustrate a modified furniture component system in which, for convenience, parts which are the same as those shown in FIGS. 1 to 7 have been indicated by corresponding reference numerals increased by one hundred.

However, it will be noted that the plate-shaped member 110 is not provided with any holes extending at an acute angle to its edges, but instead has, extending from each of its four edges, two holes 111, which are perpendicular to their respective edge.

Also, the limb 116*b* of the connecting member 116 is formed with a self-tapping screw thread 116*c*.

With this modified system, four connecting members 116 are firstly screw-threaded into engagement with two pairs of the openings 111 at opposite sides of the plate-shaped member 110, and the projecting limbs 116*a* are then push-fitted into engagement in corresponding openings 111 of an adjacent plate-shaped member similar to the plate-shaped member 110.

As will be readily apparent, these components can then be assembled into a box or box-shaped cupboard as described hereinabove with reference to FIGS. 9 to 12.

Similarly, this modified system can be employed for constructing tables in a manner similar to that hereinabove described with reference to FIGS. 16 to 18.

Also, the plate-shaped members of the above-described systems can also be connected together in coplanar, edge-to-edge relationship by straight pins inserted into the holes in the adjacent edges of the plate-shaped members, the straight pins each having a length twice that of one of the holes.

I claim:

1. A furniture component system, comprising:

a plurality of plate-shaped members; and a plurality of connecting members for connecting said plate-shaped members together;

each of said connecting members having a pair of mutually angularly divergent limbs;

each of said plate-shaped members having at least one edge formed with at least two holes extending inwardly of the respective plate-shaped member from the respective edge;

each of said holes being dimensioned to receive therein one of said connecting member limbs, and said holes being mutually parallel in selected ones of said plate-shaped members and being mutually angled in the remaining ones of said plate-shaped members, whereby each of said plate-shaped members is connectible together with an adjacent one of said plate-shaped members in mutually angularly disposed relationship allowing relative movement apart of the connected, adjacent plate-shaped members in only one direction.

2. A system as claimed in claim 1, wherein said plate-shaped members are rectangular and said connecting members are L-shaped.

3. A system as claimed in claim 2, wherein the lengths of said limbs are sufficiently longer than the lengths of said holes to provide a spacing between the plane of each of said plate-shaped members and the adjacent plate-shaped member or members connected thereto on assembly of said system.

4. A system as claimed in claim 2, wherein said holes extend perpendicularly from the respective edges of said plate-shaped members, and said connecting members are each formed on one limb thereof with a screw-thread for threaded engagement in a corresponding one of said holes.

5. A system as claimed in claim 1, wherein, in each of said selected ones of said plate-shaped members, each of said holes in said edge extends at right angles relative to said edge.

6. A system as claimed in claim 1, further including U-shaped connecting members engageable in a pair of said holes in a pair of said plate-shaped members disposed in mutually parallel and adjacent relationship for connecting together said pair of plate-shaped members.

7. A system as claimed in claim 1, further including a door stop comprising a pair of abutment members for insertion into a corresponding pair of said holes.

8. A system as claimed in claim 1, further including a door stop comprising a pair of abutment members for insertion into a corresponding pair of said holes one of said abutment members being magnetic.

9. A system as claimed in claim 1, further comprising a door latch comprising an L-shaped member having limbs of unequal lengths, the longest of said limbs having a length equal to more than the sum of the length of the corresponding one of said holes and the thickness of one of said plate-shaped members.

10. A system as claimed in claim 1, wherein said connecting members are each formed, on one limb thereof, with a self-tapping screw-thread for threaded engagement in a corresponding one of said holes.

11. A system as claimed in claim 1, wherein said holes extend perpendicularly from the respective edges of said plate-shaped members, and said connecting members are each formed on one limb thereof with a screw-thread for threaded engagement in a corresponding one of said holes.

12. A system as claimed in claim 11, further including a door stop comprising a pair of abutment members for insertion into a corresponding pair of said holes.

13. A system as claimed in claim 11, further including a door stop comprising a pair of abutment members for insertion into a corresponding pair of said holes one of said abutment members being magnetic.

14. A system as claimed in claim 11, further comprising a door latch comprising an L-shaped member having limbs of unequal lengths, the longest of said limbs having a length equal to more than the sum of the length of the corresponding one of said holes and the thickness of one of said plate-shaped members.

15. An article of furniture, comprising:

a top;

a bottom;

a pair of opposed side walls;

said top, bottom and opposed side walls each comprising a plate-shaped member having opposite edges and opposite major surfaces; and means for releasably connecting together said plate-shaped members at said edges thereof;

said connecting means comprising means defining mutually parallel first holes in said edges of said side walls, means defining mutually angled second holes in said edges of said top and said bottom and connector members snugly and slidingly engaged in said first and second holes;

said connecting members comprising first limbs engaged in said first holes and second limbs rigid with respective ones of said first limbs and engaged in said second holes, whereby said plate-shaped members are relatively movable only in the directions of said first holes; and each of said holes extending parallel to the major surfaces of its respective plate-shaped member.

16. An article of furniture as claimed in claim 15, further comprising a back, said back comprising a plate-shaped member having opposite side edges and opposite major surfaces; and means for connecting said back to said side walls, said back connecting means comprising means defining mutually parallel third holes in said side edges and parallel to the major surfaces thereof; means defining mutually angled fourth holes in said side walls and parallel to the major surfaces thereof; and back connector means having limbs snugly slidingly engaged in said third and fourth holes.

17. An article of furniture as claimed in claim 15, wherein said connector members comprise separate L-shaped members.

18. An article of furniture as claimed in claim 15, wherein said limbs are longer than said holes.

19. In a piece of furniture comprising:

first and second furniture components having first and second surfaces, respectively;

means defining holes extending into said first and second furniture components from said first and second surfaces thereof; and connecting members inserted into said holes for releasably connecting together said first and second furniture components;

said connecting members each comprising a first elongate portion inserted into said first furniture component and a second portion extending at an angle to said first portion and inserted into said second component, said first portion being rigidly connected to said second portion;

said holes in said first furniture component each extending at an acute angle to said first surface thereof;

the improvement that:

said holes in said second furniture component extend in a direction at right angles to said second surface thereof, whereby said first and second furniture components can be disconnected from one another only by relative movement thereof in said direction.

20. A piece of furniture, as claimed in claim 19, wherein said holes in said first furniture component have longitudinal axes which are convergent and coplanar.

21. A piece of furniture as claimed in claim 20, wherein said first and second furniture components are each plate-shaped with parallel opposite major surfaces, said first and second surfaces being edge surfaces of said first and second furniture components and said holes extending between and parallel to said major surfaces of the respective furniture components.

22. A piece of furniture as claimed in claim 21, wherein said holes in said first furniture component have longitudinal axes which are convergent and coplanar.

23. A piece of furniture as claimed in claim 19, wherein said connecting member portions fit in snug sliding engagement in said holes.

24. A piece of furniture as claimed in claim 19, wherein the lengths of said connecting member portions are sufficiently longer than the lengths of said holes to offset the plane of each of said furniture components from the other of said furniture components, whereby said first and second surfaces are mutually spaced apart.

25. A piece of furniture as claimed in claim 19, wherein said first and second furniture components are each plate-shaped with parallel opposite major surfaces and said holes extend between and parallel to said major surfaces of the respective furniture components.

26. A piece of furniture as claimed in claim 19, wherein said connecting members comprise a plurality of separate L-shaped connecting members.

27. A piece of furniture as claimed in claim 19, wherein said first and second surfaces are first and second edge surfaces of said first and second furniture components.

28. In an article of furniture comprising first and second furniture components and connecting means releasably securing together said furniture components, said connecting means comprising means defining holes in said furniture components and connecting members engaging in said holes, said connecting members comprising first limbs slidingly engaging in respective ones of said holes in said first component and second limbs slidingly engaging in respective ones of said holes in said second component, said second limbs each being rigid with and at an angle to a respective one of said first limbs, and said first limbs being mutually parallel to allow said first furniture component to be moved to and from said second furniture component longitudinally of said first limbs;

the improvement that:

said second limbs are mutually angled to prevent said second furniture component from being moved to and from said first furniture component longitudinally of said second limbs.

29. An article of furniture as claimed in claim 28, wherein said limbs are longer than said holes.

30. An article of furniture as claimed in claim 28, wherein said connecting members comprise separate L-shaped connecting members each comprising one of said first limbs and one of said second limbs.

31. A furniture component, comprising:

a plate-shaped member having opposed parallel major surfaces and first and second pairs of parallel opposite edges;

a pair of mutually parallel holes extending into said plate-shaped member from each of said first pair of parallel opposite edges; and a pair of mutually angled holes extending into said plate-shaped member from each of said second pair of parallel opposite edges;

said holes each extending between and parallel to the major surfaces of said plate-shaped member.

* * * * *